US008261838B2

(12) United States Patent
Bullen

(10) Patent No.: US 8,261,838 B2
(45) Date of Patent: Sep. 11, 2012

(54) ARTIFICIAL LIFT SYSTEM

(76) Inventor: Terry Bullen, Clairmont (CA)

( * ) Notice: Subject to any disclaimer, the term of this patent is extended or adjusted under 35 U.S.C. 154(b) by 346 days.

(21) Appl. No.: 12/781,131

(22) Filed: May 17, 2010

(65) Prior Publication Data

US 2010/0300701 A1 Dec. 2, 2010

Related U.S. Application Data

(63) Continuation-in-part of application No. 11/621,313, filed on Jan. 9, 2007, now Pat. No. 7,717,181.

(51) Int. Cl.
*E21B 43/16* (2006.01)

(52) U.S. Cl. ..... 166/372; 166/68

(58) Field of Classification Search ..... 166/372, 166/68, 105, 370
See application file for complete search history.

(56) References Cited

U.S. PATENT DOCUMENTS

| | | | |
|---|---|---|---|
| 1,003,946 | A | 9/1911 | Pilcher |
| 1,326,338 | A | 12/1919 | Gregory |
| 1,754,945 | A | 4/1930 | Haskell |
| 2,142,481 | A | 1/1939 | Stephens et al. |
| 2,142,484 | A | 1/1939 | Jennings |
| 2,743,676 | A | 5/1956 | Lewis |
| 2,942,663 | A | 6/1960 | Haggard |
| 3,005,413 | A | 10/1961 | Coberly |
| 3,106,170 | A | 10/1963 | Gray |
| 3,260,308 | A | 7/1966 | Cryer |
| 3,617,152 | A | 11/1971 | Cummings |
| 3,782,468 | A | 1/1974 | Kuwada |
| 3,797,968 | A | 3/1974 | Elfarr |
| 3,833,060 | A | 9/1974 | Craggs et al. |
| 3,873,238 | A | 3/1975 | Elfarr |
| 3,887,008 | A | 6/1975 | Canfield |
| 3,974,878 | A | 8/1976 | Roeder et al. |
| 4,025,235 | A | 5/1977 | Newbrough |
| 4,243,102 | A | 1/1981 | Elfarr |
| 4,377,208 | A | 3/1983 | Elliott et al. |
| 4,416,593 | A | 11/1983 | Cummings |
| 4,427,345 | A | 1/1984 | Blann et al. |
| 4,509,599 | A | 4/1985 | Chenoweth et al. |
| 4,527,633 | A | 7/1985 | McLaughlin et al. |
| 4,727,936 | A | 3/1988 | Mioduszewski et al. |
| 4,738,695 | A | 4/1988 | Carr et al. |

(Continued)

FOREIGN PATENT DOCUMENTS

WO 9822692 5/1998

OTHER PUBLICATIONS

"R-Series IPO Gas Lift Valves", Weatherford Brochure, 2005.

(Continued)

*Primary Examiner* — Hoang Dang
(74) *Attorney, Agent, or Firm* — Bennett Jones LLP

(57) ABSTRACT

An artificial lift system provides an artificial lift design specifically for the pumping of liquids from natural gas wells, but not limited to this application. In doing so, production rates and reserves recovered can be significantly increased. The artificial lift system uses small diameter continuous tubing to run the pump in the hole and deliver small volumes of high pressure dry gas as a power fluid to the pump. This power fluid forces liquid that has been drawn into the pump from the bottom of the wellbore to surface. By removing the liquids from the wellbore the natural gas can flow unrestricted to surface. The design and equipment allow for a cost effective artificial lift alternative.

5 Claims, 9 Drawing Sheets

U.S. PATENT DOCUMENTS

| | | | |
|---|---|---|---|
| 4,844,156 | A | 7/1989 | Hesh |
| 5,147,185 | A | 9/1992 | Niehaus et al. |
| 5,211,242 | A | 5/1993 | Coleman et al. |
| 5,450,901 | A | 9/1995 | Ellwood |
| 5,547,021 | A | 8/1996 | Raden |
| 5,605,193 | A | 2/1997 | Bearden et al. |
| 5,755,288 | A | 5/1998 | Bearden et al. |
| 5,911,278 | A | 6/1999 | Reitz |
| 6,021,849 | A | 2/2000 | Averhoff |
| 6,089,832 | A | 7/2000 | Patterson |
| 6,138,764 | A | 10/2000 | Scarsdale et al. |
| 6,196,310 | B1 | 3/2001 | Knight |
| 6,199,631 | B1 | 3/2001 | Knight |
| 6,209,651 | B1 | 4/2001 | Knight |
| 6,216,781 | B1 | 4/2001 | Knight |
| 6,234,248 | B1 | 5/2001 | Knight |
| 6,691,787 | B2 | 2/2004 | Amani |
| 6,873,267 | B1 | 3/2005 | Tubel et al. |
| 6,973,973 | B2 | 12/2005 | Howard et al. |
| 7,100,695 | B2 | 9/2006 | Reitz |
| 7,717,181 | B2 | 5/2010 | Bullen |
| 2002/0040785 | A1 | 4/2002 | Amani |
| 2003/0047316 | A1 | 3/2003 | Bosley |
| 2003/0085036 | A1 | 5/2003 | Curtis et al. |
| 2004/0188096 | A1 | 9/2004 | Traylor |
| 2007/0023182 | A1 | 2/2007 | Davis |
| 2007/0079970 | A1 | 4/2007 | Belcher et al. |
| 2011/0308812 | A1 * | 12/2011 | Bullen ..... 166/372 |

OTHER PUBLICATIONS

"R-1 Injection Pressure Operated Gas Lift Valve", Weatherford Technical Manual, estimated published at least as early as 2005.

"SFO-1 Side Pocket Mandrel", Weatherford Technical Manual, estimated published at least as early as 2005.

* cited by examiner

P/AT (101,102,103) – Pressure/Acoustic Transmitter
P/TT (100) – Pressure/Temperature Transmitter
M (100) – Measurement Device
PCV (100,102) – Pressure Actuated Control Valve
PCV (101) – Back Pressure Control Valve
FN (100,101) – Flow Control Nozzles
CN (100) – Control Vent Orfice
CV (100,101,103) – Check Valves
RCV (100) – Pressure Regulating Check Valve
DP (100) – Flow Dispersion Plate or Nozzle

ARTIFICIAL LIFT SYSTEM

CROSS-REFERENCE TO RELATED APPLICATION

The present application is a continuation-in-part of U.S. patent application Ser. No. 11/621,313, filed on Jan. 9, 2007, entitled "Artificial Lift System", the contents of which are incorporated herein by reference.

SUMMARY

Subterranean wells have been drilled primarily to produce one or more of the following desired products for example fluids such as water, hydrocarbon liquids and hydrocarbon gas. There are other uses for wells but these are by far the most common. These desired fluids can exist in the geologic layers to depths in excess of 5,000 m below the surface and are found in geological traps called reservoirs where they may accumulate in sufficient quantities to make their recovery economically viable. Finding the location of the desirable reservoirs and drilling the wells present their own unique challenges. Once drilled, the wellbore of the well must be configured to transport safely and efficiently the desired fluid from the reservoir to surface.

Whether or not the desired fluid can reach surface without aid is a function of numerous variables, including: potential energy of the fluid in the reservoir, reservoir driver mechanisms, reservoir rock characteristics, near wellbore rock characteristics, physical properties of the desired fluid and associated fluids, depth of the reservoir, wellbore configuration, operating conditions of the surface facilities receiving fluids and the stage of the reservoirs depletion. Many wells in the early stages of their producing life are capable of producing fluids with little more than a conduit to connect the reservoir with the surface facilities, as energy from the reservoir and changing fluid characteristics can lift desired fluids to surface.

Typically fluids in a liquid phase cause the most problems when attempting to move the fluids vertically up the wellbore. Fluids in the liquid phase are much denser than fluids in a gaseous phase and therefore require greater energy to lift vertically. These fluids in the liquid phase can enter the wellbore in the liquid state as free liquids or they can enter the wellbore in the gas phase and later condense into liquid in the wellbore due to changing physical conditions. The liquids that enter the wellbore may be desirable fluids, such as hydrocarbon liquids or useable water, or they may be liquids associated with the desired fluids, for example, water produced with oil or gas. Often the liquids associated with the desired fluids must be produced in order to recover the desired fluid. Regardless of the desirability of the liquid, energy is required to transport the liquid vertically from the reservoir to surface. Optimizing the energy required through improved wellbore dynamics or with the aid of artificial lift has been an area of intense study and literature for those dealing with subsurface wells.

To improve the economics of a well, it is desirable to increase the production rate and maximize the recovery of the desired fluid from the well. Transportation of fluids from reservoir to surface, that is well bore dynamics, is one of the variables of the well that can be controlled and has a major impact on the economics of a well. One can improve the well bore dynamics by two methods—1) designing a wellbore configuration that optimizes and improves the flow characteristics of the fluid in the well bore conduit or 2) aiding in lifting the fluid to surface with artificial lift. Artificial lift can significantly improve production early in the life of many wells and is the only options for wells if they are to continue producing in the later stages of depletion. Regardless of whether the well can lift the desired fluids to surface on its own or requires artificial lift, the well bore dynamics should be reviewed continually as the variables change over the life of the well and the economics for the well need to be maximized.

The methods of improving flow characteristics include: proper tubing selection, plunger systems, addition of surface tension reducers, reduced surface pressures, downhole chokes and production intermitters. These methods do not add energy to the fluids in the well bore, and therefore are not considered artificial lift systems; however, they do optimize the use of the energy that the reservoir and fluids provide. These methods optimize the well bore dynamics and/or add energy to the fluid transportation process at the surface. Depending on the application, each of the different methods above has numerous models and configurations each having their own unique advantages and disadvantages.

There are numerous systems of artificial lift available and operating throughout the world. The more common systems are reciprocating rod string and plunger pumps, rotating rod strings and progressive cavity pumps, electric submersible multi-stage centrifugal pump, jet pumps, hydraulic pumps and gas lift systems. Again, depending on the intended application, each of the different systems has numerous models each having their own unique advantages and disadvantages. To fit in the category of artificial lift, additional energy not from the producing formation and fluids is input into the well bore to help lift fluids in the liquid phase to surface. The artificial lift systems listed above have been developed for water and hydrocarbon liquids as they require the greatest assistance when being transported to surface and provide the greatest economic incentive. They also have applications in lifting liquids that are associated with the gas in natural gas wells.

With the depletion of the world gas reserves there is a need to develop an artificial lift system that is better suited to removing liquids associated with natural gas production from the wellbore. These liquids, if not removed from the wellbore, will significantly limit the natural gas production rates as wells as the ultimate recovery of the natural gas reserves.

Other artificial lift systems have been designed and used based on injection of high-pressure gas. Gas lift is a common form of artificial lift and relies on injection of enough gas to reach the critical rate for removing liquids from the wellbore (Turner et al in 1969: Turner, R. G., Hubbard, M. G., and Dukler, A. E., 1969, "Analysis and Prediction of Minimum Flow Rate for the Continuous Removal of Liquids from Gas Wells," J. Pet. Technol., 21 (11), pp. 1475-1482.)

U.S. Pat. No. 5,211,242 by Malcolm W Coleman and J Byron Sandel outlines the complete removal of fluids from the well on each cycle, which requires large gas volume and therefore large associated equipment with pumping, for example large tubing, a large compressor, large power source valves, etc.

There is a need for pumps that can be installed and serviced without the use of a service rig using wireline or coiled tubing equipment and techniques, to allow for easy installation and servicing. There is a need for pumps that fit with existing technologies, services and equipment, and may fit with existing wellbore configurations with only minor modifications.

SUMMARY

In an embodiment there is an artificial lift system, comprising a gas compressor, a gas pump seated downhole in a well and a power conduit. The power conduit extends along the well and provides a fluid connection between the gas pump and the gas compressor.

In an embodiment there is an artificial lift system comprising a downhole pump, a power conduit connected to the gas pump and a downhole release mechanism between the power conduit and the downhole pump.

In an embodiment there is a method of installing a downhole pump in a well, the method comprising the steps of connecting a downhole pump to coil tubing and lowering the downhole pump into the well.

In an embodiment there is a method of removing an artificial lift system from a wellbore, comprising the steps of disconnecting a power conduit from a downhole pump, pulling the power conduit from the wellbore and pulling the downhole pump from the wellbore.

In one aspect, the invention comprises an artificial lift system, comprising:

(a) a gas compressor;
(b) a gas pump seated downhole in a well;
(c) a power conduit extending along the well and providing a fluid connection between the gas pump and the gas compressor;
(d) a pressure actuated fill valve and a pressure regulating check valve, together operating as a three-way valve, disposed between the gas pump and the power conduit;
(e) a bleed valve and a bleed valve control line, connected to the power conduit between the pressure actuated fill valve and the pressure regulating check valve; and
(f) a vent orifice connected to the bleed valve control line, for relieving the pressure difference actuating the bleed valve.

In another aspect, the invention may comprise a method of operating an artificial lift system as described herein, comprising the steps of:

(a) pumping or compressing a power fluid in the power conduit to a point above a set point of the pressure actuated fill valve in order to pressurize the gas pump;
(b) wherein the set point of the pressure actuated fill valve is higher than the discharge pressure of the gas pump;
(c) closing the bleed valve with pressure downstream of the fill valve;
(d) opening the bleed valve by dissipating pressure in the bleed valve control line through the vent orifice.

BRIEF DESCRIPTION OF THE FIGURES

Embodiments will now be described with reference to the figures, in which like reference characters denote like elements, by way of example, and in which.

DETAILED DESCRIPTION

In the claims, the word "comprising" is used in its inclusive sense and does not exclude other elements being present. The indefinite article "a" before a claim feature does not exclude more than one of the feature being present.

Figure 1:
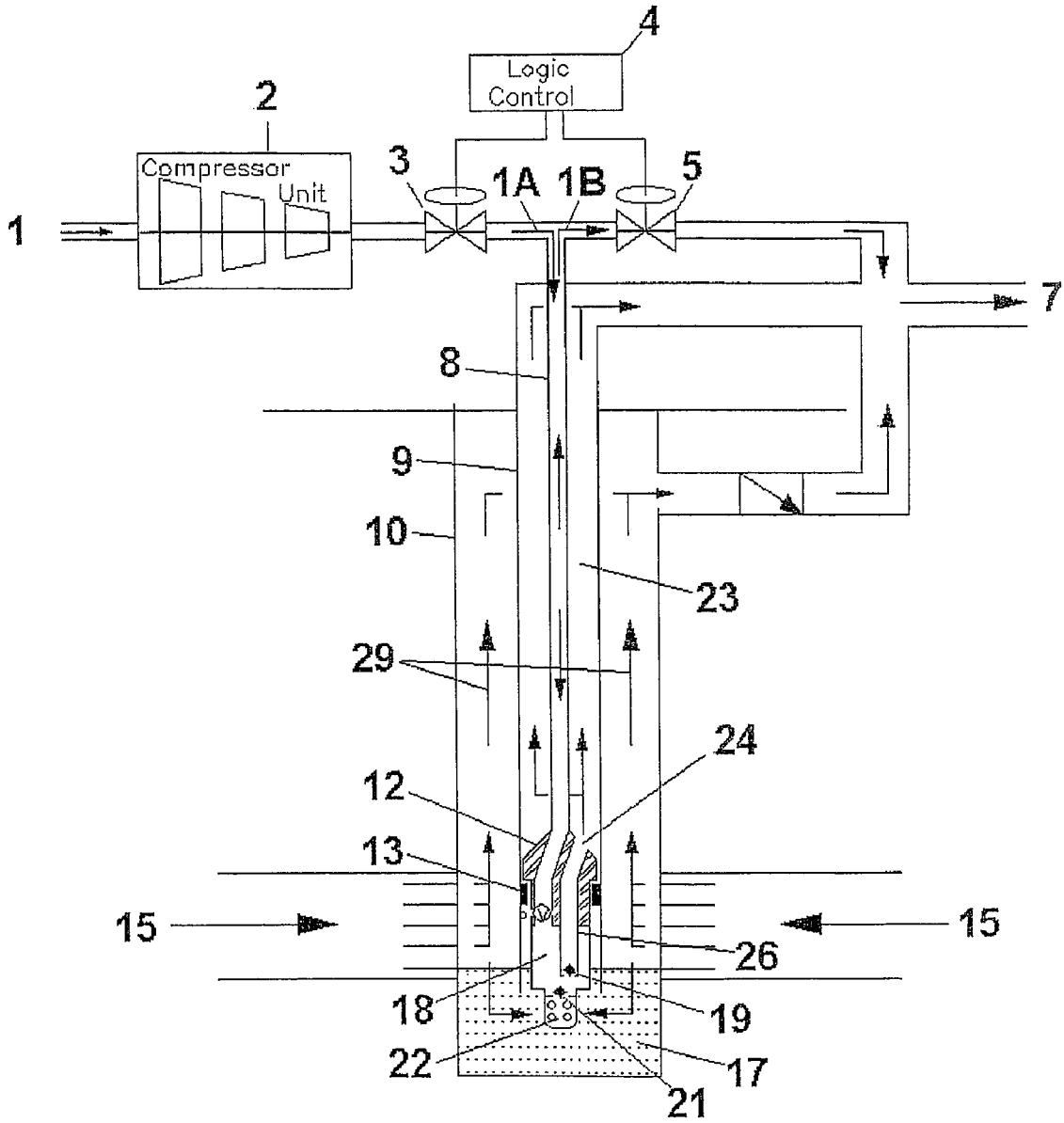
FIG. 1 is a section view of a wellbore showing the producing formation.

FIG. 1 is an embodiment of a wellbore showing a reservoir 15, a drilled hole from surface to the producing formation, a liquid conduit 23, including casing 10 and tubing string 9 that safely transport the producing fluids from the reservoir to surface. Also included in the drawing is the equipment associated with the pump: a downhole pump 12, small diameter continuous tubing string 8, a compressor unit 2 and a logic controller 4. The small diameter continuous tubing string 8 is also called a power conduit, a power fluid conduit or small diameter continuous tubing.

In an embodiment, an artificial lift system uses high pressure dry gas 1A as the power fluid to pump liquids from the bottom of gas wells, therefore allowing gas to flow unrestricted to surface, for example, the gas may flow to the surface unrestricted by liquid build up in the wellbore. In doing so the production rate of the gas can be increased and additional reserves recovered.

FIG. 1 shows an embodiment of the device, in which a downhole pump 12 is driven by high pressure gas from the surface. High pressure dry gas 1A is injected down a dedicated small diameter continuous tubing 8 into a pump pressure chamber 18 at the bottom of the well expelling any liquid present in the pump pressure chamber 18 through an exit check valve 19 and out of a liquid discharge port 24 at the top of the downhole pump 12. After the liquid in the pump pressure chamber 18 has been expelled, the pressure in the pump pressure chamber 18 is bled off. When depressurized, liquid from the bottom of the wellbore 17 is allowed to enter the pump pressure chamber 18 through the check valve 21 on an inlet screen 22 at the bottom of the downhole pump 12. To achieve maximum efficiency the pump pressure chamber 18 is allowed sufficient time to completely fill with liquid and to completely expel that liquid before the cycle repeats itself.

In order to recover the desired fluids from a reservoir 15, casing 10 and tubing string 9 are run in the well for the safe and efficient transportation of a desired fluid from the reservoir to the surface facilities 7 using acceptable oilfield designs. Initially, the reservoir fluids often have sufficient energy in the form of pressure to transport the desired fluids and associated fluids from the reservoir 15 to the bottom of the wellbore 17, and then from the bottom of the wellbore 17 to the surface facilities 7 without the aid of artificial lift equipment. However, once a well has reached a stage of depletion where there is insufficient energy available to transport the fluids vertically to surface the economics may justify the addition of artificial lift. Artificial lift aids in the vertical transportation of the fluids in the liquid phase from the bottom of the wellbore 17 to the surface facilities 7. Typically the fluids in the liquid and gas phases are allowed to separate in the bottom of the wellbore 17. Due to density differences, since liquids are of much higher densities, the fluids in the liquid phase drop to the bottom of the wellbore 17 where they can be pumped to surface facilities 7 up the small diameter continuous tubing 8 by the artificial lift equipment. The fluids in the gas phase require much less energy to be transported vertically up the wellbore when the liquids are not interfering with this transportation. The fluids in the gas phase are allowed to flow up a tubing annulus 29 unrestricted by the fluid in the liquid phase.

For description purposes an embodiment of a downhole pump in a wellbore has been broken into three main components: surface equipment, a wellbore conduit and a downhole pump.

A compressor unit 2 comprises a gas dryer, a high pressure compressor coupled with a drive unit, an accumulator 6, a logic controller 4, a surface fill valve 3 and a surface bleed valve 5. This equipment provides a power fluid, for example a high pressure dry gas 1A, necessary to operate the downhole pump 12. The compressor unit 2 takes natural gas from the well or other desired source 1 and removes any contaminants including water. After cleaning the gas it is compressed to the desired operating pressure for the downhole pump 12 and stored in the accumulator until required to operate the pump. The operating pressure is the sum of the hydrostatic pressure of the liquid column between surface and the downhole pump 12, the pressure of the surface equipment the liquid is being discharged into, and the desired preset pump activation pressure that insures efficient operation of the pump. The accumulator 6 is connected to the small diameter continuous tubing 8, through a surface fill valve 3. Downstream of the surface fill valve 3 there is a surface bleed valve 5. These valves are controlled by the logic controller 4 which open and closes the valves for the different stages of the pumping cycle.

A power fluid conduit 8 comprising small diameter continuous tubing runs from the compressor unit 2 to the downhole pump 12. The power fluid conduit 8 delivers the power fluid 1A from the compressor unit 2 to the downhole pump 12 during the pressurization stage and from the downhole pump 12 to the surface facilities 7 during the depressurization stage.

Figure 2:
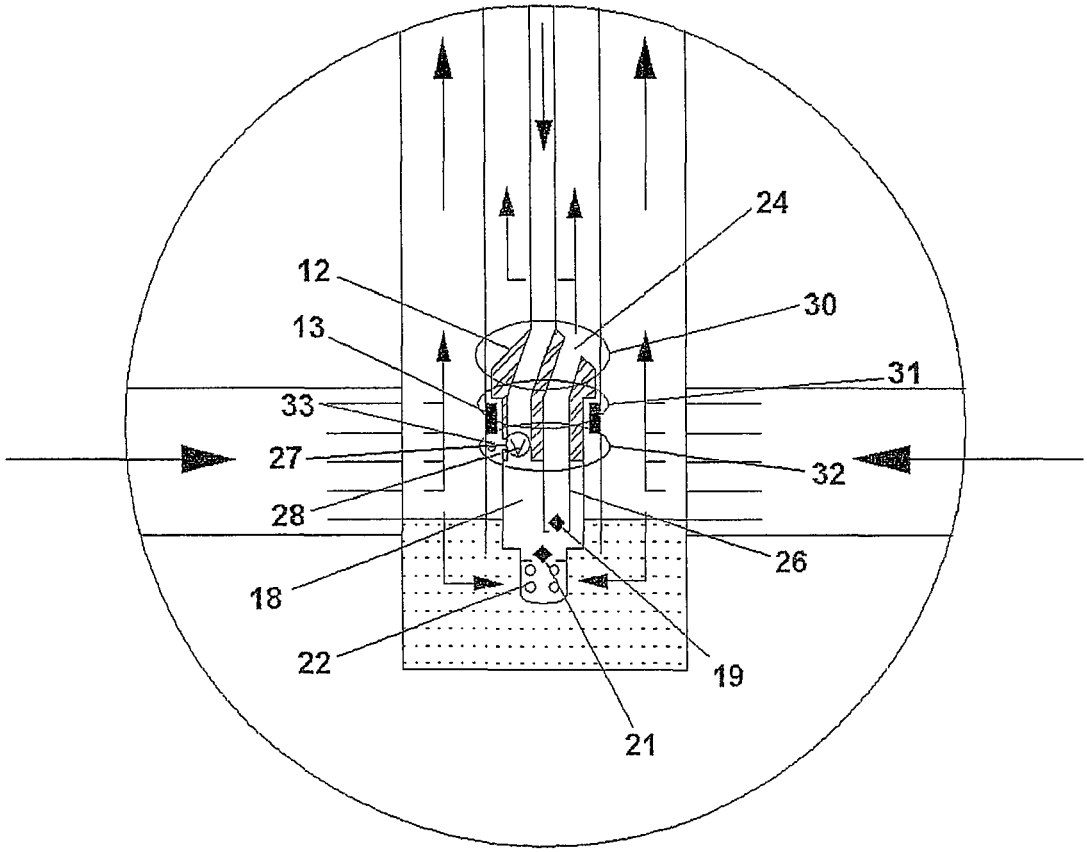
FIG. 2 is a section view of an embodiment of downhole components of a wellbore showing the production formation.

FIG. 2 shows an embodiment of the device in which a downhole pump 12 comprises a number of parts required for operation and serviceability of the pump. At the top of the downhole pump 12 is a connector head 30 which connects, releases and seals the power fluid conduit 8 to the downhole pump 12. Below the connector head 30 is a pump seating assembly 31 which comprises: an internal fish neck 78 (FIG. 5) for setting and retrieving the pump, the liquid discharge port 24, a NoGo ring 88 (FIG. 5) to hold the pump in position, an external seal pack 90 (FIG. 5) to isolate the liquid conduit 23 from the bottom of the wellbore 17, a connection between the connector head 30 and the pump pressure chamber 18 for the power fluid and a primary equalizing port 72 (FIG. 5) for pulling of the pump. Below the pump seating assembly 31 is a pump pressure chamber connector 32 with the connection between the pump pressure chamber 18 and the power fluid conduit 8 directly or via the downhole fill valve 100 (FIG. 6) and downhole bleed valve 28 and the connections from the liquid exit tube 26 to the liquid discharge port 24 on the pump seating assembly 31. The downhole fill valve 100 (FIG. 6) and downhole bleed valve 28 work together and as an assembly is also called a three way valve 28, 100. Below the pump pressure chamber connector 32 is the pump pressure chamber 18 which acts as a receptacle for liquids on the intake stage and a pressure chamber on the discharge stage of the pumping cycle and the liquid exit tube 26 is inside the pump pressure chamber 18 connecting an exit check valve 19 on the bottom of the liquid exit tube 26 to the liquid discharge port 24 on the pump pressure chamber connector 32. On the bottom of the downhole pump 12 is an inlet check valve 21 and an inlet screen 22.

In an embodiment, a downhole pump 12 is run in a wellbore hole on small diameter continuous tubing 8 using a conventional wireline unit having a drawworks or specially built coiled tubing unit. The downhole pump 12 has a NoGo ring 88 (FIG. 5) and an external seal pack 90 (FIG. 5) that seat in a profile 13 at the bottom of the well that is part of the existing tubing string 9. Landing the downhole pump 12 in the profile 13 holds the downhole pump 12 in place and also seals the small diameter continuous tubing 8 inside a liquid conduit 23 above the profile 13 separate from the bottom of the wellbore 17. Once in place, the small diameter continuous tubing 8 acts as the conduit to deliver high pressure dry gas 1A to the pump pressure chamber 18 and acts as a conduit to bleed off the pump pressure chamber 18 once liquids have been expelled from the pump pressure chamber 18. The annular area between the small diameter continuous tubing 8 and the existing tubing string 9 act as the liquid conduit 23 to deliver the liquid expelled from the liquid discharge port 24 to surface facilities 7. The downhole pump 12 has two check valves, one at a inlet check valve 21 where liquid from the bottom of the wellbore 17 enters the pump pressure chamber 18 and one at an exit check valve 19 where liquids are expelled from the pump pressure chamber 18 into the liquid exit tube 26 and then into the liquid conduit 23.

In an embodiment, there are three stages in a pumping cycle; the first stage starts with the pump pressure chamber 18 depressurized to a pressure below the pressure external to the intake check valve 21.

In the first stage of the pump cycle time is allowed for fluids external to the pump pressure chamber 18, for example at the bottom of the wellbore 17, to flow into the pump pressure chamber 18 through the inlet check valve 21.

In the second stage of the pump cycle time is allowed for the compressor unit 2 and accumulator to supply high pressure dry gas 1A at a sufficient pressure down the power fluid conduit 8 to the pump pressure chamber 18 to expel the liquid from the pump pressure chamber 18 through the exit check valve 19 into the liquid exit tube 26 and then out the liquid discharge port 24 into the liquid conduit 23.

In the third stage of the pump cycle time is allowed for the depressurizing of the pump pressure chamber 18 which can be done in multiple ways. Three exemplary embodiments for methods of depressurizing the pump pressure chamber are as follows:

In an embodiment of one method the gas pressure 1B is bled back to surface facilities 7 through the power fluid conduit 8 and surface bleed valve 5. This approach of bleeding off pump pressure chamber 18 and power fluid conduit 8 reduces efficiency and pump capacity but is mechanically simple and therefore is often applicable in shallower wells.

In an embodiment of a second method, a pressure activated downhole fill valve 100 (FIG. 6) and downhole bleed valve 28 are installed. These two valves 100, 28 act together as a three-way valve. This second method allows for a more efficient pump operation by only bleeding off a small amount of the gas pressure 1B from the power fluid conduit 8. When the power fluid conduit 8 is pressured up above the set point of the three way valve, the power fluid conduit 8 and the pump pressure chamber 18 are in communication and the pump pressure chamber 18 is isolated from the downhole bleed port 27 allowing pump pressure chamber 18 to be pressurized. When the power fluid conduit 8 is bled off to below the set point of the three way valve 28 & 100 (FIG. 6) the power fluid conduit 8 is isolated from the pump pressure chamber 18, at the same time the pump pressure chamber 18 and the downhole bleed port 27 are in communication allowing the pump pressure chamber 18 to be depressurized.

Figure 8:
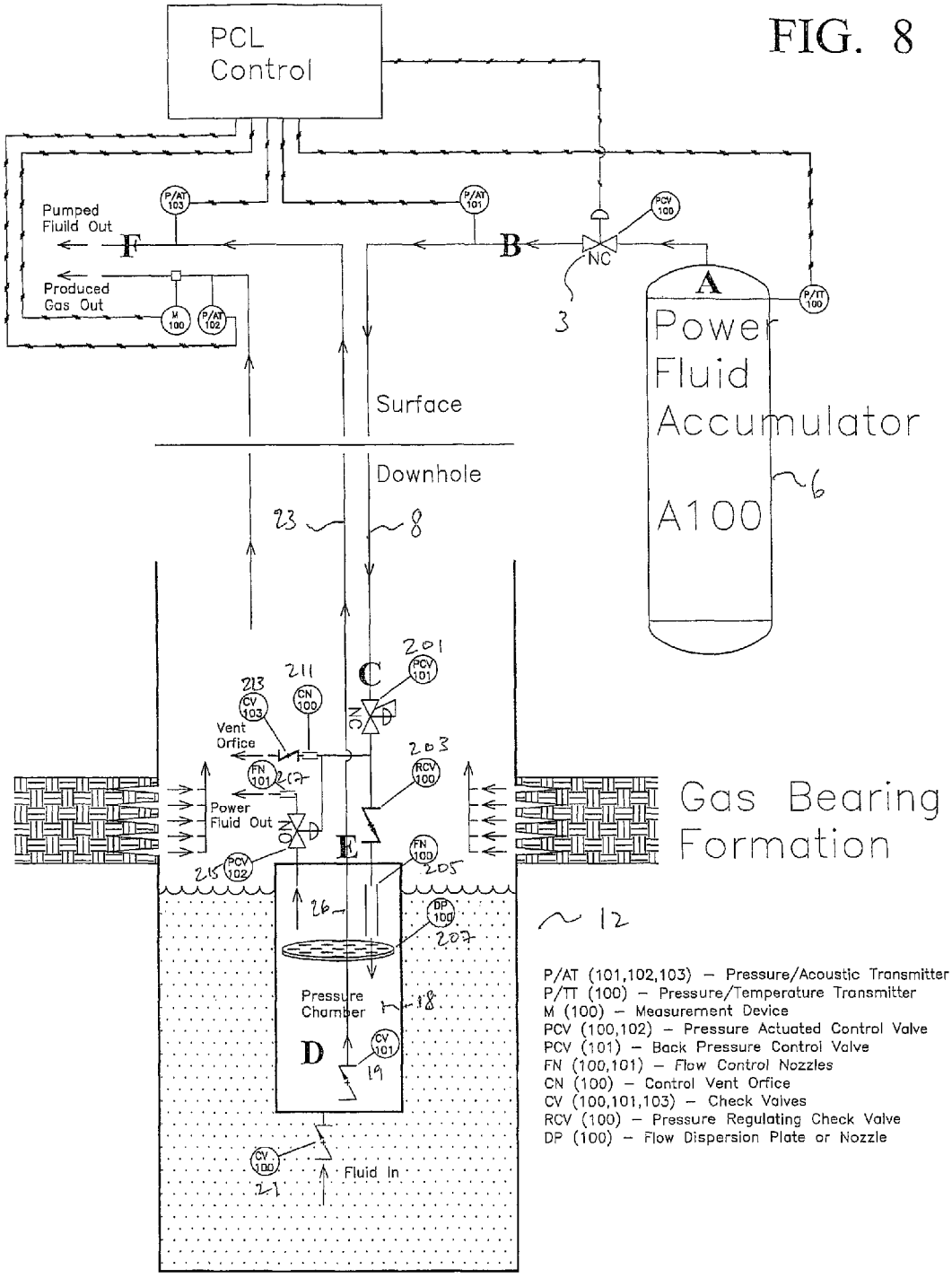
FIG. 8 is a schematic depiction of an alternative embodiment of the invention.

In an alternative embodiment, schematically illustrated in FIG. 8, a back pressure control valve 201 and a fill check valve 203 are installed between the power fluid conduit 8 and the pressure chamber 18. The outlet of the power fluid conduit 8 into the pressure chamber 18 comprises a flow control nozzle 205 which reduces the pressure drop across valves 201 and 203. Flow control nozzle is a sacrificial nozzle which bears the brunt of the high velocity gas flow, instead of the fill check valve 203. In one embodiment, a diffuser plate 207 also diffuses the high velocity gas flow into the pressure chamber 18, reducing the jetting action of the gas, and excessive agitation of the fluid being displaced, which may result in erosion of the chamber 18 and foaming of liquid within the chamber 18. There is also the risk of gas bypassing liquid when the chamber 18 is being evacuated. The diffuser plate may be a diffusing nozzle or other means of diffusing high velocity gas flow.

Downstream from the back pressure control valve 201 is a connection to control vent orifice 211 and vent check valve 213. A vent orifice check valve 213 prevents well bore fluids from entering the control vent orifice 211.

Bleed valve 215 allows escape of the power fluid through a flow control nozzle 217. Bleed valve 215 is actuated by the pressure differential between a point upstream from the fill check valve 203 and the downhole bleed port 27. The flow control nozzle 217 transfers high velocity flow from the bleed valve 215 to the nozzle 217, thereby extending the valve life by making it less susceptible to erosion.

In an embodiment of a third method, a back pressure control valve 201 (FIG. 8) and downhole bleed valve 215 are installed in similar manner as described above, acting as a 3-way valve. This third method allows for even greater efficiency in pump operation by not bleeding off a small amount of the gas pressure 1B from the power fluid conduit 8. This is achieved by setting the set point for which the back pressure valve 201 opens and closes higher then the required discharge pressure of the pump chamber. When the power fluid conduit 8 is pressured up above the set point of the back pressure valve 201 the power fluid conduit 8 and the pump pressure chamber 18 are in communication and the pump pressure chamber 18 is isolated from the downhole bleed port 27 allowing pump pressure chamber 18 to be pressurized. When the liquid in the pressure chamber has been fully discharged and the power conduit pressure will continue to drop to a pressure at which the back pressure valve 201 will close. Once the back pressure valve 201 is closed, the small volume of pressurized gas holding the bleed valve 215 in a closed position is bled off through control vent orifice 211. Once this small volume is bled off, the bleed valve 215 opens. At this time the pump pressure chamber 18 and the downhole bleed port 27 are in communication allowing the pump pressure chamber 18 to be depressurized.

Figure 9:
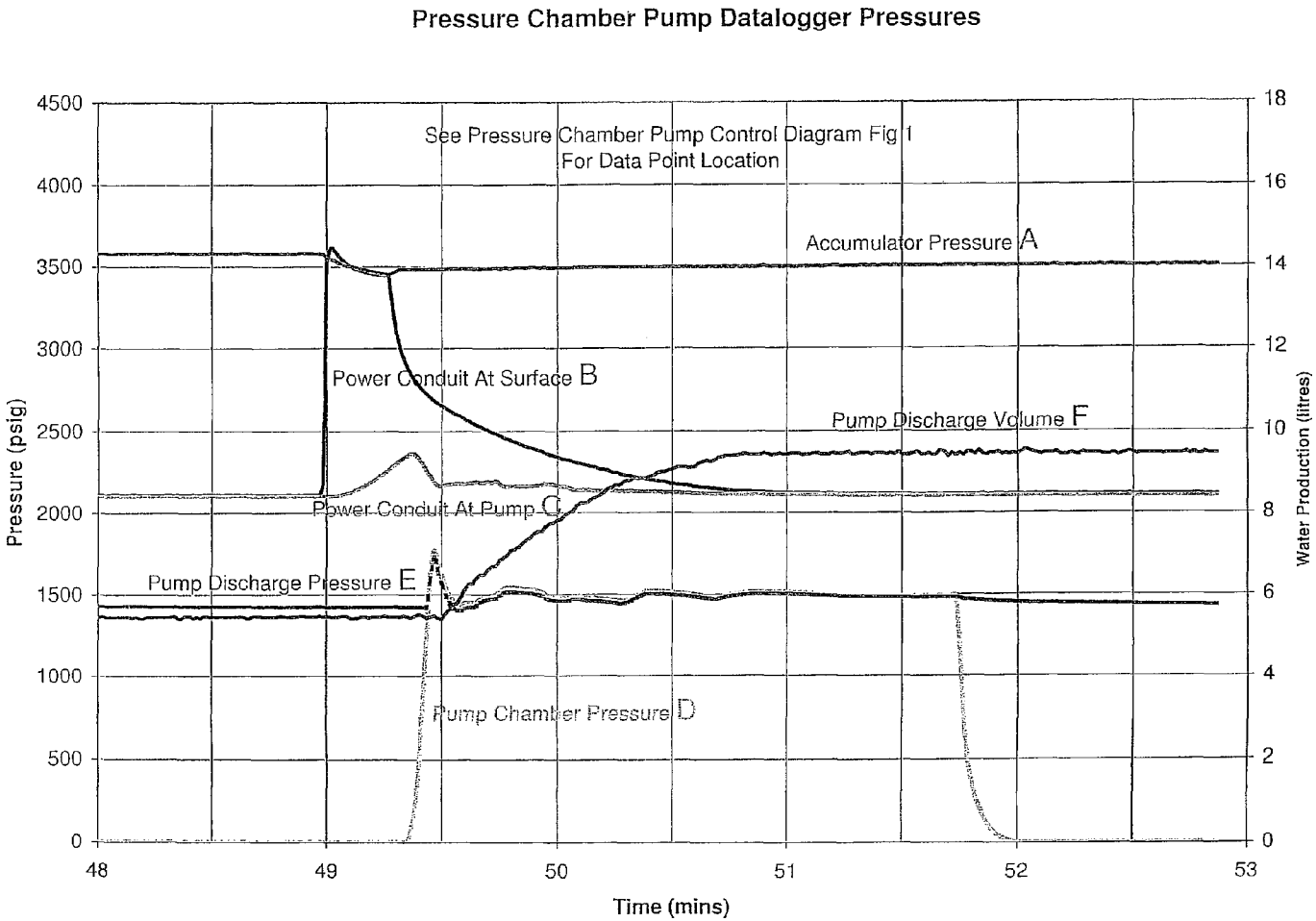
FIG. 9 is a graph showing pressure cycles in a typical pump cycle.

A typical pump cycle comprises the three stages described above. FIG. 9 shows pressure at 5 different points in the system during an example pump cycle, as well as liquid production from the pump.

Pressure in the accumulator 6 remains relatively constant (A) through the cycle, dipping only slightly at the start of the pressurization state at approximately 49 minutes. Pressure in the power fluid conduit 8 rises dramatically (B) at the start of the pressurization stage as valve 3 opens. Pressure at the pressure chamber inlet (C), upstream from back pressure control valve 201 rises somewhat as power fluid is pushed downhole, and then levels off when the back pressure control valve 201 and fill check valve 203 opens into the pressure chamber 18. At the time when the back pressure control valve 201 opens, the bleed valve 215 is actuated to the closed position. Pressure in the pressure chamber (D) rises dramatically when the back pressure control valve 201 and the fill check valve 203 opens at about 49.3 minutes. Pressure within the pressure chamber is maintained for a few minutes by flow of the power fluid, resulting in a steady increase of water production from the pump. Pump discharge pressure (E) has a baseline value resulting from the hydrostatic head of fluid in the liquid conduit 23, and increases slightly when the pressure chamber is pressurized. The discharge pressure is maintained at its slightly elevated level while the pressure chamber remains pressurized, and then returns slowly to its baseline value after the pressure chamber pressure is allowed to discharge.

The third stage is the final stage in the pump cycle. All the stages may be controlled by a logic controller 4 using time and/or pressure and are adjusted based on the application requirements.

Now installation and removal of an embodiment of an artificial lift system will be described.

In an embodiment, to ensure a cost effective installation and positive working results one must first review and analyze the working conditions of the well. This includes gathering information on the configuration of the wellbore, such as casing size, tubing size and depth, type and location of profiles in tubing string, type and location of packer that may isolate a tubing annulus, depth of perforations and restriction and/or objects that may interfere with the running of the pump in the well. Fluid characteristics should also be determined—gas density, water density and hydrocarbon liquid density along with their expected production rates. Pressures and temperatures at the pump intake and surface outlet must also be determined through measurement or estimated. Once gathered, this information can be used to calculate the desired configuration of the equipment and operating parameters.

In an embodiment, an artificial lift system is designed to work with existing wellbore equipment and configurations but if the existing wellbore configuration is less than optimum for pumping liquids it may need to be modified. As an example, a possible wellbore configuration is as follows: production depth of the well not greater than 3000 m, clean 60 mm tubing string or larger, one profile located at bottom of the perforations or lower, no tailpipe below the profile or a 6 mm hole 33 in tailpipe immediately below profile, 5 m of clean cased hole below bottom of perforations, no packer in hole that would restrict flow up the tubing annulus. Such a wellbore configuration is very similar to that of the common oilwell rod pump installation; where the liquids are pumped up the tubing string and the gas flows up the tubing annulus. However in this design, instead of a rod string being run inside the existing tubing string, the rods are replaced by the small diameter continuous tubing 8 that delivers high pressure gas 1A to drive the pump which is a pump pressure chamber 18 rather then a plunger style pump. Existing wellheads may be utilized by installing a production blowout preventer (BOP) 40 (FIG. 3) into the top of the existing flow tee. The production BOP 40 (FIG. 3) provides the primary seal around the small diameter continuous tubing 8. Above the production BOP 40 (FIG. 3) is a device to suspend the small diameter continuous tubing 8 in the well and above this device there is a pack-off 45A (FIG. 4) to provide a secondary seal around the small diameter continuous tubing 8. The existing master valves will need to be locked open to prevent damage to the small diameter continuous tubing 8. In an emergency the master valves could be shut, cutting the small diameter continuous tubing 8 to shut-in the well.

In an embodiment, once a wellbore has been configured for pumping conditions and pumping equipment has been selected, the artificial lift system can be constructed for the application and surface tested. The downhole pump 12 is run in the hole on the small diameter continuous tubing 8 using the drawworks of conventional wireline or coiled tubing methods and equipment. A variety of equipment may be used as a lift unit to run and pull the pump, such as an electric line unit, a braided line unit, a slickline unit, a wireline unit and a logging unit. The pump can be run down the existing tubing string 9 under pressure conditions or with the existing tubing string 9 in a killed state. To run in under pressure one can use conventional wireline or coiled tubing BOPs, lubricator, grease injector and pack-off equipment following wireline or coiled tubing procedures. The downhole pump 12 and small diameter continuous tubing 8 are run in the hole to the depth where the pump seating assembly 31 is landed in the profile 13. First the external seal pack 90 (FIG. 5) on the external diameter of the pump seating assembly 31 are landed in the sealing section of the desired profile 13 (FIG. 1) and the production BOP 40 (FIG. 3) and service BOP 44 (FIG. 3) on top of the wellhead are closed around the small diameter continuous tubing 8. Then the liquid conduit 23 may then be filled with water and the tubing, external seal pack 90 (FIG. 5) and production BOP 40 and service BOP 44 (FIG. 3) may be pressure tested. After proving the integrity of the components the small diameter continuous tubing 8 is hung off at surface and the pack-off 45A (FIG. 4) is installed. The small diameter continuous tubing 8 is then detached or cut off and a valve 45B (FIG. 4) is installed on the end of the small diameter continuous tubing, disconnecting it from the unit which ran it into the well. Cutting the small diameter continuous tubing off and installing the valve 45B, makes it possible to connect the small diameter continuous tubing 8 to the compressor unit 2.

In an embodiment, once the downhole pump 12 and power fluid conduit 8 are installed the power fluid conduit 8 can be connected to a compressor unit 2. Cycle times and pressure settings calculated in the pump configuration program are input into the logic controller 4. To start the pump, the power fluid conduit 8 and the pump pressure chamber 18 are pressurized to the desired operating pressure. During the pressurization stage the pressure in the power fluid conduit 8 will activate the three way valve 28 & 100 (FIG. 6) in the top of the downhole pump 12 at the set pressure of the three way valve 28 & 100 (FIG. 6), closing the downhole bleed port 27 and opening the pump pressure chamber 18 to the power fluid conduit 8. Once the required operating pressure has been reached in the pump pressure chamber 18, liquid in the pump pressure chamber 18 is expelled through the exit check valve 19 into the liquid exit tube 26, out the downhole pumps liquid discharge port 24 and into the liquid conduit 23. No backflow will be allowed due to the exit check valve 19. Once the appropriate time has passed to expel liquid from the pump pressure chamber 18, the timer will close the surface fill valve 3 and open the surface bleed valve 5. At this point the bleed down cycle will begin. During the bleed down cycle, gas is bled from the power fluid conduit 8 at surface through the surface bleed valve 5 to the flowline. To monitor the pump operation, a surface liquid conduit valve 38C should remain closed until the desired increase in pressure is observed. A number of pump cycles may be required to see the desired pressure response. Depending on the downhole pump 12 configuration, downhole three way valve installed or no downhole three way valve installed, the timing on the bleed down stage of the pump cycle will need to be configured appropriately.

For the downhole three way valve configuration: the pressure on the power fluid conduit 8 is reduced, until it is below the pressure set point to actuate the downhole three way valve. The three way valve closes the pressure chamber depressurization port 110 (FIG. 6) which connects with the pump pressure chamber 18 and opens the downhole bleed port 27 allowing the pump pressure chamber 18 to bleed off to the area external to the pump below the downhole pump sealing profile 13. Once sufficient time has passed to allow the pump pressure chamber 18 to fully depressurize additional time is allowed for the pump pressure chamber 18 to fill completely with liquid. Once filled completely with liquid the next pump pressurization stage begins. To control the rate at which liquid is pumped from the well, the times allowed for stage 3 & 2 can be adjusted. The times for these stages must remains above the calculated minimum times required to depressurize and fill the pump pressure chamber 18.

For the no downhole three way valve configuration: the pressure on the power fluid conduit 8 is reduced until it is below the bottomhole flowing pressure of the well. Here typical pipeline flowing pressure may be used. Once sufficient time has passed to allow the pump pressure chamber 18 to fully depressurize additional time is allowed for pump pressure chamber 18 to fill completely with liquid. Once filled completely with liquid, the next pump pressurization stage begins. To control the rate at which liquid is pump from the well, the times allowed for stage 3 & 2 can be adjusted. The times for these stages must remains above the calculated minimum times required to depressurize and fill the pump pressure chamber 18 with liquid.

To pull the artificial lift system one must release or cut the power fluid conduit 8 immediately above the internal fish neck 78 (FIG. 5) and pull the small diameter continuous tubing 8 out of the well. The small diameter continuous tubing 8 is not normally strong enough to pull the downhole pump 12 out of the well. Prior to pulling the downhole pump 12 the pressure above the downhole pump 12 must be equalized with the pressure below the downhole pump 12. This is done by removing some of the liquid from the liquid conduit 23. This can occur automatically if the primary equalization port 72 is not plugged, allowing liquids above pump to drain back into the bottom of the wellbore 17 once the connecting head is released 62. If it is undesirable to allow liquids to drain back into the bottom of the wellbore 17 the primary equalization port 72 may be plugged and the use of conventional swab equipment and techniques to remove the liquid from the liquid conduit may be employed. Swabbing the tubing minimizes the fluid that drains back into formation once the equalizing plug of the downhole pump has been broken off. As a backup if primary equalization port 72 becomes plugged or swabbing is unable to be performed the liquid may be drained through the backup equalizing port 74 by running in the hole with slickline tools, break off the equalizing plug inside the internal fish neck 78 (FIG. 5) on the downhole pump 12 allowing the liquids above the downhole pump to drain back into the well below the sealing profile at the bottom of the wellbore 17. After equalizing the pressure above and below the downhole pump 12, run in with wireline equipment with sufficient line size and tool configuration to unseat the gas pump and pull the gas pump to surface and latch on to the internal fish neck 78 (FIG. 5) and pull downhole pump 12 to surface.

Once the downhole pump 12 has been pulled from well, the downhole pump 12 can be repaired and reinstalled or other activities conducted on well as desired using normal oilfield procedures.

Figure 3:
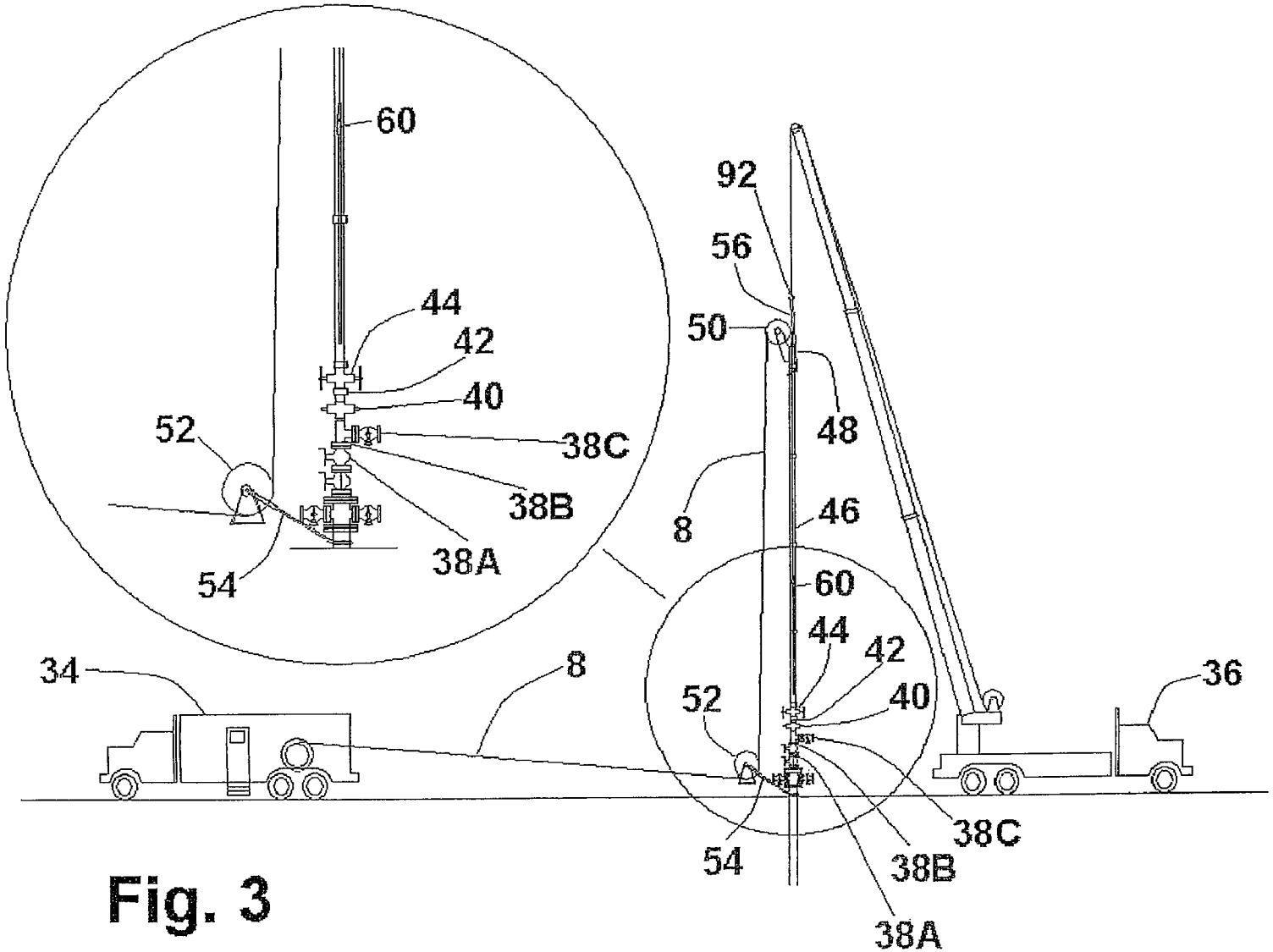
FIG. 3 is a side view showing an embodiment of the installation of a gas pump in a wellbore.

In an embodiment shown in FIG. 3, an artificial lift system makes use of conventional electric line and slickline methods and equipment, making installing and removal of the artificial lift system effective, quick and safe. A conventional electric line or slickline unit 34 is placed approximately 50 ft from an existing wellhead 38 and a crane unit 36 is placed next to the wellhead 38. Other orientations of the slickline unit 34 and crane unit 36 will also work. Other suitable equipment for running and pulling an artificial lift system may alternatively be used. The conventional slickline unit 34 installs small diameter coiled tubing 8 on cable or wire draw workings. The small diameter coiled tubing 8 replaces the conventional cable or wire. In an embodiment the wellhead 38 comprises a top master valve 38A, a flow tee 38B and a wing valve 38C.

To install, sections of lubricator 46 are laid out on ground stands and which when connected together are of sufficient length to enclose a complete artificial lift system 60 assembly. In the embodiment shown in FIG. 3, the artificial lift system 60 is hanging in the lubricator sections 46 prior to running in hole. In an embodiment, the sections of lubricator 46 are used to contain pressure while running and pulling the artificial lift system 60 from the well. The sections of lubricator 46 could be, for example, a lubricator section of Bowen type such as PN 14339. A service BOP 44 is connected to the bottom of the lubricator sections. The service BOP 44 is installed for running and pulling the artificial lift system 60. The service BOP 44 could be, for example, a service BOP of Bowen type such as PN 57678. The bottom of the artificial lift system 60 is inserted into the top of the lubricator sections 46.

Figure 5:
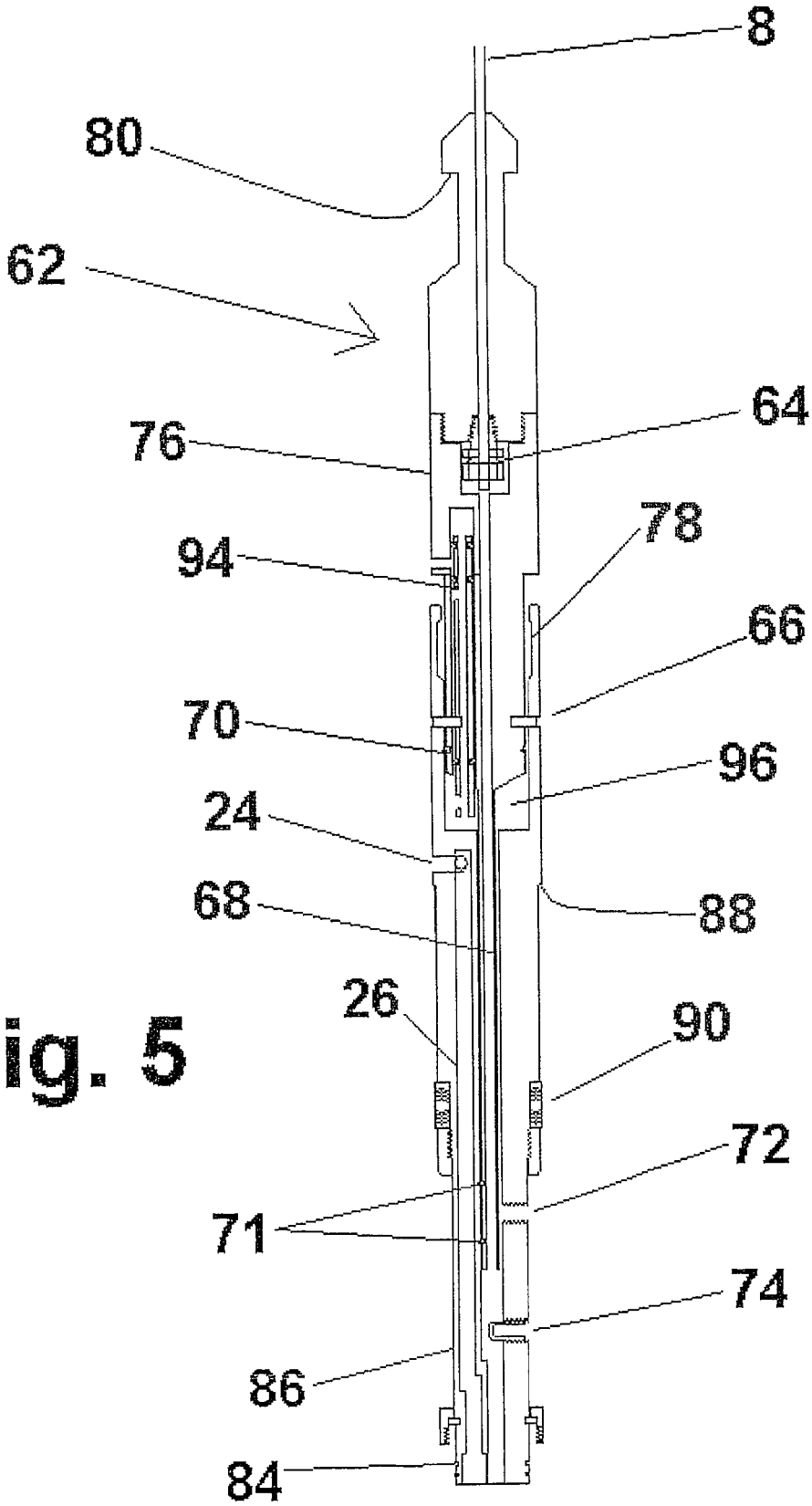
FIG. 5 is a section view of an embodiment of a downhole release mechanism.

Some of the power conduit 8 is spooled out from the slickline unit 34 and the power conduit is threaded through a top block assembly 50 combined with a pack-off 48. A make up connection is used between the power conduit 8 and the downhole release mechanism 76, an embodiment of which is shown in FIG. 5.

Next, the top block assembly 50 combined with pack-off 48 is installed to the top of lubricator sections 46. The top block assembly 50 redirects the path of the small diameter coiled tubing 8 and supports the weight of the small diameter coiled tubing 8 as well as the weight of an artificial lift system assembly, comprising the artificial lift system 60, attached to the end of the small diameter coiled tubing 8. The top block assembly 50 could be, for example, a top block of Bowen type, such as PN 44677. The downhole release mechanism 76 is connected to the artificial lift system assembly that was inserted in the top of the lubricator sections 46. After the downhole release mechanism 76 is connected to the artificial lift system assembly, the artificial lift system 60 is pushed completely into the lubricator sections 46 and the top block assembly 50 is connected to the top of the lubricator sections 46. A cap (not shown) is inserted on the bottom of the service BOP 44 to ensure the artificial lift system assembly does not fall out the bottom when it is raised.

Next, the wellhead is prepared for being connected to the lubricator sections 46. A pressure reading is taken. The top master valve 38A and the wing valve 38C are both closed. The pressure trapped between these two valves is bled to 0 psig using the flow tee 38B bleed valve. The cap (not shown) is removed from the flow tee 38B and a production BOP 40 is installed into the internal connection of the flow tee 38B. In an embodiment, the production BOP 40 comprises a modified sucker rod BOP with rams modified to seal on the small diameter coiled tubing 8. An adaptor nipple 42 is installed into the top of the production BOP 40. The adapter nipple 42 connects the production BOP 40 to the service BOP 44.

Next the lubricator sections 46 is prepared for being connected to the wellhead. A top block support cable 56 is installed between the top block assembly 50 and a crane hoisting cable hook 92. A pack-off 48 with the power conduit 8 threaded through is attached to the lubricator sections 46. The top block support cable 56 supports the weight of and stabilizes the movement of the power conduit 8, the artificial lift system 60, the top block assembly 50, the pack-off 48 and the lubricator section 46. The top of lubricator section 46 is lifted until lubricator sections 46 are hanging vertical. The power conduit 8 may need to be spooled out at the same time so that it does not get damaged as the lubricator sections 46 are lifted. A bottom block 52 and a tie down cable 54 are installed. The power conduit 8 is threaded through the bottom block 52. The bottom of the lubricator sections 46 is positioned directly over the wellhead. The bottom block 52 redirects the path of the small diameter coiled tubing 8 and supports the weight of the small diameter coiled tubing 8 as well as the weight of the pump assembly attached to the end of the small diameter coiled tubing 8. The bottom block 52 assembly could be, for example, a bottom block of Bowen type, such as PN 14414. The lubricator sections 46 when assembled together comprise a lubricator assembly.

The power conduit 8 is spooled so that slack in the power conduit 8 is removed and the artificial lift system is no longer resting on the cap (not shown) on the bottom of the service BOP 44. The cap (not shown) is removed from bottom of service BOP 44. In an embodiment, the artificial lift system 60 is lowered out the bottom of the lubricator assembly 46 to a measurement datum and a depth counter is adjusted appropriately. The artificial lift system 60 is raised into the lubricator assembly 46 and lubricator assembly 46 is lowered onto the top of the wellhead and the connection is made. The lubricator assembly 46 is then pressure tested to the appropriate pressure.

At this point, the artificial lift system 60 is ready to run in the hole. The top master valve 38A is opened. The artificial lift system 60 is run down to a desired depth. The artificial lift system landing assembly is landed in a desired profile 13 (FIG. 1) in the well. Thus, the artificial lift system 60 and the power conduit 8 are now in place. A pressure test can be carried out to ensure that no leaks are present in the power conduit 8 or the liquid conduit 23 (FIG. 1).

In an embodiment, handles on the top master valve 38A and bottom master valves are locked and warning signs are installed to warn against the operation of the valves. The production BOP 40 is closed and the pressure is bled from the lubricator assembly 46 to 0 psig.

The adaptor nipple 42 is disconnected from the bottom of the lubricator assembly and the lubricator assembly 46 is raised. Approximately 200 feet of power conduit 8 is pulled down through the lubricator assembly 46 and the power conduit 8 is cut off at the bottom of lubricator assembly 46. Other lengths of power conduit 8 may be pulled down through the lubricator assembly 46.

Figure 4:
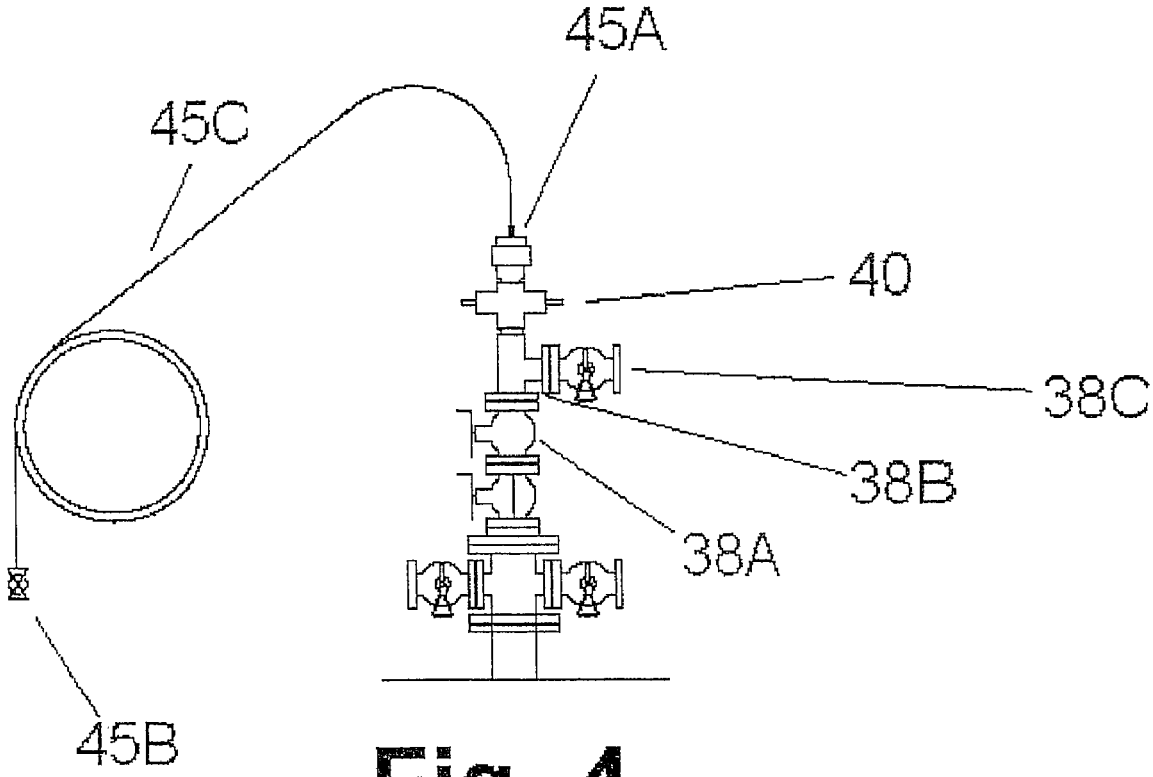
FIG. 4 is a side view showing an embodiment of the surface components of a gas pump.

In an embodiment of the installation shown in FIG. 4, a production BOP 40 is connected to the top of the wellhead which comprises a top master valve 38A, a flow tee 38B and a wing valve 38C. A production pack-off 45A is connected to the top of the production BOP 40. A length of surplus power conduit 45C, for example, approximately 200 feet long, is coiled and a valve 45B lies on the end of the surplus power conduit 45B.

The surplus power conduit 45C must remain attached and will be required for the pulling operation. The adaptor nipple 42 (FIG. 3) is removed from the production BOP 40 and a production pack-off 45A is installed on top of the production BOP 40. The 200 feet of surplus power conduit 45C protruding from top of the production pack-off 45A is coiled and a valve 45B is installed on the end of the surplus power conduit 45C.

After installation of the artificial lift system, the slickline unit 34 (FIG. 3), the crane unit 36 (FIG. 3) and associated equipment are rigged out. Surface equipment associated with the artificial lift system 60 (FIG. 3) is installed and pump operation is started.

An embodiment of a downhole release sub 62 is shown in FIG. 5. The downhole release sub 62 comprises a downhole release mechanism 76 and a downhole pump connector 86 being releasably attached to the downhole release mechanism 76. The downhole release mechanism 76 is an embodiment of the connector head 30 shown in FIG. 1. The downhole pump connector 86 is an embodiment of the pump seating assembly 31 shown in FIG. 1. A power conduit 8 is attached at one end to the downhole release mechanism 76. A power fluid extension prong 68 is attached to the base of the downhole release mechanism 76. A connection fitting 64 attaches the power conduit 8 to the downhole release mechanism 76. The downhole pump connector 86 is releasably attached to the downhole release mechanism 76 by breakable fastenings, such as release shear pins 66. A chamber 96 lies between the downhole release mechanism 76 and the downhole pump connector 86. The chamber 96 is pressure sealed with pressure seals 70 which lie below the release shear pins 66. A pressure release mechanism, such as release equalizing stem 94, lies between the downhole pump connector 86 and the downhole release mechanism 76 and provides a fluid connection between the exterior of the downhole release mechanism 76 and the chamber 96.

An external fish neck lies at the top of the downhole release mechanism 76 where the power conduit 8 connects to the downhole release mechanism 76. A fish neck, for example internal fish neck 78, is attached to the top of the downhole pump connector 86. Below the chamber 96 is a liquid discharge port 24 at the end of liquid exit tube 26. Below the liquid discharge port 24 is a NoGo ring 88. At some point below the NoGo ring 88 is an external seal pack 90. A primary equalizing port 72 lies on the exterior of the downhole pump connector 86. Pressure seals 71 seal the power fluid extension prong 68 from the primary equalizing port. A backup equalizing port 74, as shown in FIG. 5, may also be present if additional equalizing ports are necessary. A connection interface, such as threading 84, lies on the base of the downhole pump connector 86.

The downhole release mechanism 76 is designed to release the power conduit 8 from the downhole pump after an application of external pressure on both the power conduit 8 and the downhole release mechanism 76 that is sufficient to break breakable fastenings, such as release shear pins 66. Pressure is applied to the area exterior to the power conduit 8 defined by the liquid conduit 23. The release shear pins 66 are to be sized so as not to release under normal operating condition yet shear below safe operating limits of the liquid conduit 23 (FIG. 1) and the wellhead. The pressure seals 70 maintain fluid pressure between the chamber 96 and a liquid conduit (FIG. 1) exterior to the downhole release mechanism 76. Power fluid is pumped down the power conduit 8 through the power fluid extension plug 68 into the pump pressure chamber 18 (FIG. 1) below the downhole release mechanism 76. Production fluid that is returning to surface from the pump pressure chamber 18 (FIG. 1) passes through the liquid exit tube 26 and through the liquid discharge port 24 into the liquid conduit 23 (FIG. 1). The pump pressure chamber 18 (FIG. 1) may be connected, for example by threads 84, to the base of the downhole pump connector 86. In an embodiment the downhole pump connector 86 may sit on the profile NoGo ring 88 in a seat in the profile 13 (FIG. 1) of the wellbore.

Once sheared, the downhole release mechanism 76 can be pulled apart from the internal fish neck 78 on the artificial lift system which in turn opens a primary equalizing port 72 connecting the liquid conduit 23 (FIG. 1) and the bottom of the wellbore 17 (FIG. 1). Pressure seals 71 maintain fluid pressure around the primary equalizing port 72. In an embodiment, the backup equalizing port 74 may also be used to equalize the pressure between the liquid conduit 23 (FIG. 1) and the bottom of the wellbore 17 (FIG. 1). When the power fluid extension prong 68 is removed from the wellbore the primary equalizing port 72 supplies a direct connection between the bottom of the wellbore 17 (FIG. 1) and the chamber 96. After the removal of the downhole release mechanism 76, the chamber 96 lies within the liquid conduit 23 (FIG. 1). Alternatively, the primary equalizing port 72 may be plugged if draining of fluid back into the bottom of wellbore 17 (FIG. 1) is undesirable. The release equalizing stem 94 equalizes the pressure in a chamber 96 lying between the downhole release mechanism 76 and the internal fish neck 78 with the pressure lying exterior to the chamber 96. Other methods of releasing the residual pressure in the artificial lift system and the downhole release mechanism 76 may also be used provided that pressures in the wellbore are sufficiently equalized to allow the downhole release mechanism 76 to be pulled from the wellbore. The power conduit 8 and the downhole release mechanism 76 can be pulled from the wellbore once released. The external seal pack 90 sits below the NoGo ring 88 and the wellbore profile 13 (FIG. 1).

Figure 6:
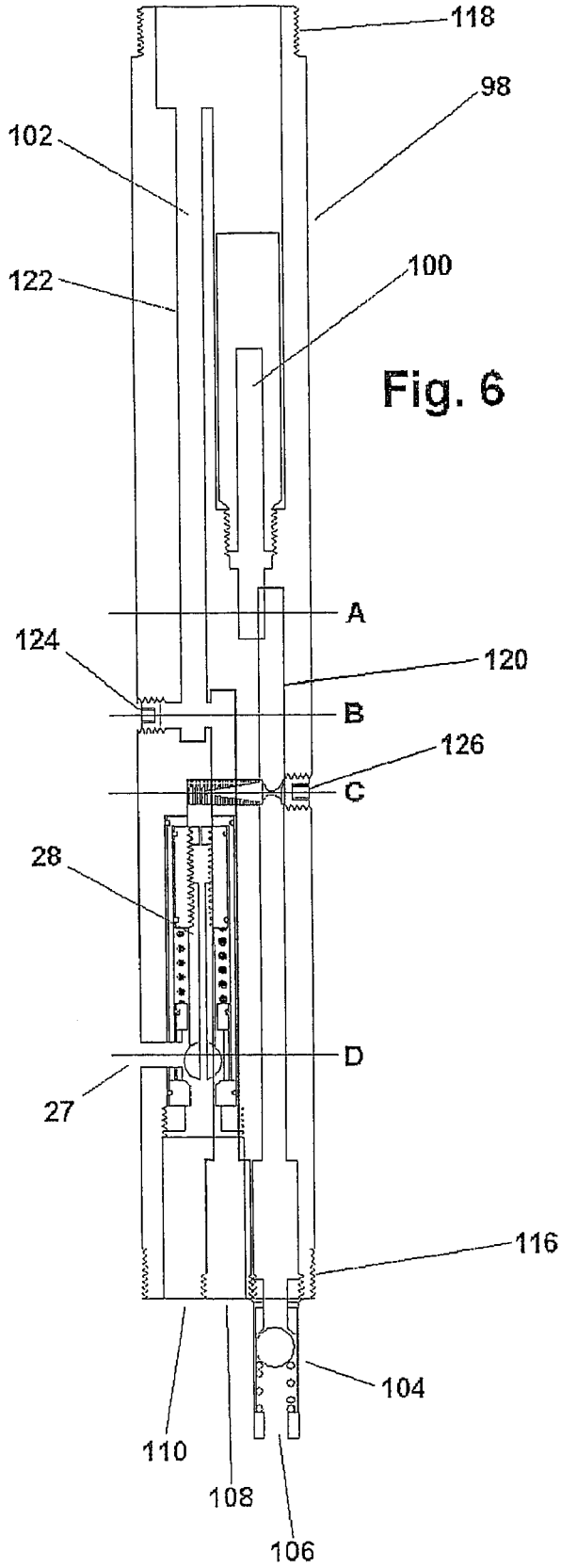
FIG. 6 is a section view of an embodiment of a downhole valve body.

An embodiment of a downhole valve body 98 is shown in FIG. 6. A downhole valve body 98 is designed to provide power fluid to the pump chamber by a pressure actuated gas lift valve 100. The downhole valve body 98 is an embodiment of the pump pressure chamber connector 32 shown in FIG. 2. In use, the downhole valve body 98 is attached by an external thread connection 116 to a downhole pump 12 (FIG. 1) and attached by threading 118 to the downhole pump connector 86 (FIG. 5). The downhole pump comprises a pump pressure chamber 18 (FIG. 1) and could be, for example, the downhole pump shown in the embodiment of FIG. 2. Power fluid is supplied to the pump pressure chamber 18 (FIG. 1) when sufficient pressure to open a gas lift valve 100 is applied. The gas lift valve 100 is pressure activated to facilitate supplying power fluid to the pump pressure chamber. From the gas lift valve 100 the pressure fluid flows through a fluid conduit 120 into a pressure regulating check valve 104 and through a power fluid outlet 106 to the pump pressure chamber 18 (FIG. 1). Between the gas lift valve 100 and the pressure regulating check valve 104 is a passage to the actuator of the pump chamber pressure release valve 28 from the fluid conduit 120. The power fluid being supplied to the pump pressure chamber 18 (FIG. 1) closes the pump chamber release valve and therefore the connection between the pump pressure chamber 18 and the downhole bleed port 27. Once the pump pressure chamber 18 (FIG. 1) is pressurized to full operating pressure the liquid in the pump pressure chamber 18 (FIG. 1) is expelled into a liquid inlet 108 through a liquid conduit 122 and out a valve body liquid port 102. The liquid inlet 108 includes a liquid exit tube 26 and an exit check valve 19 (FIG. 1). On a separate port adjacent to the liquid inlet 108 and the power fluid regulating check valve connection 104 is a pump chamber pressure depressurization port 110. Once this part of the cycle is complete the pressure that activates the gas lift valve 100 is reduced and the gas lift valve 100 closes. With the gas lift valve 100 closed the pump chamber pressure release valve 28 opens to make a connection between the pump pressure chamber 18 (FIG. 1) and the downhole bleed port 27 allowing the pressure in the pump pressure chamber to be bled off. The pump pressure chamber 18 (FIG. 1) is attached by external thread connection 116 to the downhole valve body 98. After bleeding, liquid from the well bore can enter the pump pressure chamber 18 (FIG. 1) for the next pumping cycle.

Figure 7A:
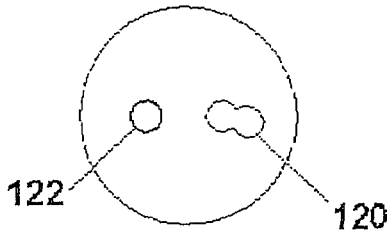
FIG. 7A, FIG. 7B, FIG. 7C and FIG. 7D are sectional views of the embodiment of a downhole valve body of FIG. 6 along the lines A, B, C, and D, respectively.

FIGS. 7A, 7B, 7C and 7D show cross section views of the embodiment of FIG. 6 along the lines A, B, C and D, respectively. FIG. 7A shows a joint in the fluid conduit 120 that allows the fluid conduit 120 below the joint to lie more to the radial exterior of the downhole valve body below the line A than the fluid conduit does above the line A. In other embodiments such a joint may not be necessary.

Figure 7B:
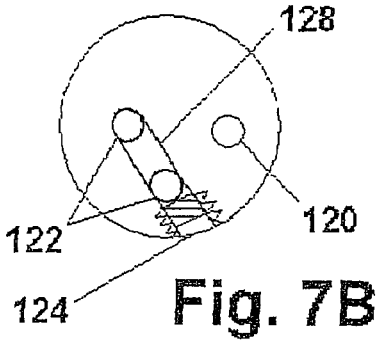

FIG. 7B shows a cross section of the embodiment of FIG. 6 along the line B. The cross section indicates a horizontal connecting passage 128 to be used in an embodiment where liquid conduit 122 could not be drilled straight through the downhole valve body 98 (FIG. 6). A threaded plug 124 separates the liquid conduit 122 from the exterior of the downhole valve body 98 (FIG. 6). In other embodiments horizontal connecting passage 128 may not be necessary.

Figure 7C:
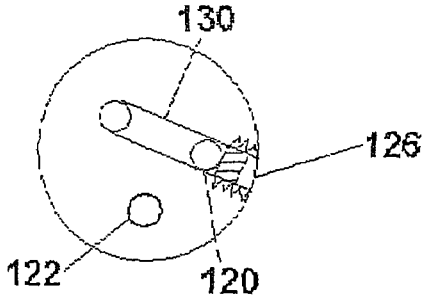

FIG. 7C shows a cross section of the embodiment of FIG. 6 along the line C. The cross section indicates a horizontal connecting passage 130 to be used in an embodiment where fluid conduit 120 could not be drilled straight through the downhole valve body 98 (FIG. 6). A threaded plug 126 separates the fluid conduit 120 from the exterior of the downhole valve body (FIG. 6). In other embodiments horizontal connecting passage 130 may not be necessary.

Figure 7D:
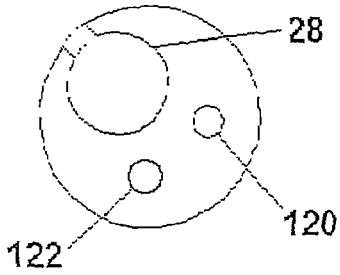

FIG. 7D shows a cross section of the embodiment of FIG. 6 along the line D. The cross section shows the pump chamber downhole bleed valve 28, the fluid conduit 120 and then liquid conduit 122.

In an embodiment, once it has been determine that the artificial lift system 60 needs to be pulled, a pressure unit (not shown) is brought in to shear the downhole release mechanism 76 of the artificial lift system. The wing valve 38C is closed, the pressure unit is connected to the liquid conduit 23 via the wing valve 38C and the connections are pressure tested.

The pressure from the power conduit 8 is bled to 0 psig. The wing valve 38C is opened and the liquid conduit 23 is pressured up to the desired pressure to shear the breakable fastenings 66 of the downhole release mechanism 76. The power conduit 8 is pressured up to ensure release has been effective. Then the wing valve 38C is closed and the pressure unit is rigged out.

In an embodiment, if the pressure unit fails to break the breakable fastenings of the downhole release mechanism 76 the external fish neck 80 may be latched on to using wireline tools and the release mechanism sheared and pulled from the wellbore. Prior to the wireline tools latching on to the external fish neck 80 the power fluid conduit 8 must first be cut immediately above the external fish neck 80 and pulled from the wellbore. Wireline can be attached to the downhole release mechanism 76 at the external fish neck 80, and hammer tools can break the breakable fastenings of the downhole release mechanism 76. Then the downhole release mechanism 76 may be pulled from the well.

In an embodiment, the artificial lift system 60 may be left for a period of time, for example 24 hours, to allow the liquid in the liquid conduit 23 to drain back into the bottom of the wellbore 17 equalizing pressure above and below the artificial lift system 60. However, there is also the potential to swab liquid from the well in the case that draining fluid back is determined to be an undesirable activity. Other methods of equalizing pressure above and below the artificial lift system 60 may also be used.

Gas well pump removal equipment, such as a slickline unit 34 and a crane unit 36 are rigged in to pull the power conduit 8 and the artificial lift system 60 from the wellbore. In an embodiment the slickline unit 34 may rigged in approximately 50 ft from wellhead 38 and crane unit 36 next to wellhead. Other placements of the slickline unit 34 and crane unit 36 are possible.

Sections of lubricator 46 are laid out on ground stands. The sections of lubricator 46 are connected together with sufficient length to enclose the complete artificial lift system assembly. The service BOP 44 is installed to bottom of the lubricator sections 46.

Pressure is bled off the power conduit 8, the surplus power conduit 8 is uncoiled and the valve (not shown) connected to the surface end of power conduit 8 is removed. The production pack-off is removed from the top of production BOP 40 and the adaptor nipple 42 is installed in the top of the production BOP 40.

The end of the surplus power conduit 8 is thread through the bottom of service BOP 44 to the top of the lubricator sections 46. The end of the surplus power conduit 8 is thread through the lubricator pack-off 48 combined with the top block assembly 50. The pack-off/top block assembly 50 is connected to the top of the lubricator sections 46. The top block support cable 56 is installed between the top block assembly 50 and the crane hoisting cable hook 92.

The top of the lubricator assembly 46 is lifted until the lubricator assembly 46 is hanging vertically above the well head. The surplus power conduit is pulled through the lubricator assembly 46 so that the surplus power conduit can be connected to the slickline unit 34. The bottom block 52 and the tie down cable 54 are installed. The power conduit 8 is threaded through the bottom block 52.

The end of the power conduit 8 is connected to the slickline unit 34. The slack from the power conduit 8 is pulled onto the slickline unit's draw works and the lubricator assembly 46 is lowered onto the wellhead connection and the connection is made. The lubricator assembly 46 is pressure tested to appropriate pressure.

The production BOP 40 is opened and the power conduit and the downhole release mechanism 76 are pulled from well.

Once the power conduit and the downhole release mechanism 76 are pulled from the well, the top master valve 38A is closed and the lubricator assembly 46 is laid down. The equipment is then reconfigured to run in a conventional slickline configuration which replaces the power conduit 8 with conventional slickline (not shown) and pulling string (not shown). In an embodiment the pulling string (not shown) comprises a rope socket, sinker bars, mechanical jars, hydraulic jars and a pulling tool.

Then, the equipment is rigged in and run in hole. While running in the hole, the liquid level should be determined to ensure the pressure above and below the artificial lift system 60 have equalized. A secondary equalizing mechanism, such as the backup equalizing port 74, may be activated at this time, if necessary. A pulling tool (not shown) is latched onto the internal fish neck 78 and the artificial lift system 60 is pulled from the hole.

The artificial lift system 60 is pulled into the lubricator assembly 46. The top master valve 38A is closed. The pressure in the lubricator assembly 46 is bled to 0 psig. The service BOP 44 is disconnected from the adaptor nipple 42 and a cap is installed on the bottom of the service BOP 44. The lubricator assembly 46 is laid down with artificial lift system 60 inside. The adaptor nipple 42 and production BOP 40 are removed from the top of the wellhead. The original wellhead cap (not shown) is re-installed.

The artificial lift system 60 is removed by pulling out the bottom of the lubricator assembly 46 and the artificial lift system 60 is disconnected from the pulling tool.

After the artificial lift system 60 is successfully removed, the slickline equipment, slickline unit 34 and crane unit 36 may be rigged out.

In an embodiment the artificial lift system may be developed to be operable with existing technology, services and components. In an embodiment artificial lift system may be designed to fit within existing wellbore configurations with only minor modification. In an embodiment the artificial lift system may be designed to not gas lock. In an embodiment the artificial lift system may allow for easy installation and servicing. In an embodiment the artificial lift system may be designed to reduce energy consumption. In an embodiment the artificial lift system may be designed for simplicity and trouble free operation. In an embodiment the artificial lift system may be designed as a cost effective pumping alternative.

As will be apparent to those skilled in the art, various modifications, adaptations and variations of the foregoing specific disclosure can be made without departing from the scope of the invention claimed herein.

What is claimed is:

1. An artificial lift system, comprising:

(a) a gas compressor;

(b) a gas pump seated downhole in a well;

(c) a power conduit extending along the well and providing a fluid connection between the gas pump and the gas compressor;

(d) a pressure actuated fill valve and a pressure regulating check valve, together operating as a three-way valve, disposed between the gas pump and the power conduit;

(e) a bleed valve and a bleed valve control line, connected to the power conduit between the pressure actuated fill valve and the pressure regulating check valve; and (f) a vent orifice connected to the bleed valve control line, for relieving the pressure difference actuating the bleed valve.

2. The artificial lift system of claim 1 further comprising a first flow control nozzle downstream of the pressure actuated fill valve.

3. The artificial lift system of claim 2, further comprising a second flow control nozzle downstream of the bleed valve.

4. The artificial lift system of claim 1 wherein the vent orifice comprises a control vent check valve.

5. A method of operating an artificial lift system as claimed in claim 1, comprising the steps of:

(a) pumping or compressing a power fluid in the power conduit to a point above a set point of the pressure actuated fill valve in order to pressurize the gas pump;

(b) wherein the set point of the pressure actuated fill valve is higher than the discharge pressure of the gas pump;

(c) closing the bleed valve with pressure downstream of the fill valve;

(d) opening the bleed valve by dissipating pressure in the bleed valve control line through the vent orifice.

* * * * *